US007487992B2

(12) United States Patent
Pascal et al.

(10) Patent No.: US 7,487,992 B2
(45) Date of Patent: Feb. 10, 2009

(54) SNOWBOARDING BINDING

(75) Inventors: Jean-Marc Pascal, Voreppe (FR); Laurent Perret, Voiron (FR); Olivier Haupt, Voiron (FR); Christophe Papon, Montferrat (FR)

(73) Assignee: Skis Rossignol, Moirans (FR)

( * ) Notice: Subject to any disclaimer, the term of this patent is extended or adjusted under 35 U.S.C. 154(b) by 166 days.

(21) Appl. No.: 11/480,516

(22) Filed: Jul. 5, 2006

(65) Prior Publication Data

US 2007/0007750 A1 Jan. 11, 2007

(30) Foreign Application Priority Data

Jul. 5, 2005 (FR) ..... 05 52062

(51) Int. Cl.
*A63C 9/00* (2006.01)

(52) U.S. Cl. ..... 280/619; 280/621; 280/623

(58) Field of Classification Search ..... 280/619, 280/620, 621, 622, 611, 617, 618, 623, 625, 280/626, 627, 628, 629
See application file for complete search history.

(56) References Cited

U.S. PATENT DOCUMENTS

| | | | | |
|---|---|---|---|---|
| 5,409,244 | A * | 4/1995 | Young | 250/14.22 |
| 6,588,773 | B1 * | 7/2003 | Van Riet et al. | 280/14.22 |
| 6,679,515 | B2 * | 1/2004 | Carrasca | 280/619 |
| 6,938,904 | B2 * | 9/2005 | Dalgaard | 280/14.21 |
| 6,945,543 | B2 * | 9/2005 | De Bortoli et al. | 280/14.21 |
| 7,021,649 | B2 * | 4/2006 | Pascal | 280/617 |
| 7,237,793 | B2 * | 7/2007 | Messmer | 280/619 |
| 7,281,730 | B2 * | 10/2007 | Davies et al. | 280/623 |
| 2003/0038456 | A1 | 2/2003 | Carrasca | |

FOREIGN PATENT DOCUMENTS

| | | | |
|---|---|---|---|
| EP | 1 491 240 | A1 | 12/2004 |
| FR | 2 838 979 | A1 | 10/2003 |
| WO | WO 96/24412 | A1 | 8/1996 |
| WO | WO 03/031001 | A1 | 4/2003 |

* cited by examiner

*Primary Examiner*—Christopher P Ellis
*Assistant Examiner*—John D. Walters
(74) *Attorney, Agent, or Firm*—Browdy and Neimark, P.L.L.C.

(57) ABSTRACT

Snowboard binding (1), comprising a base (2) on which a foot-gripping strap (10) is mounted, and in which strap (10) is capable of moving around a transversal axis (8) to enable strap (10) to be folded towards base (2), and in which at least part of strap (10) is capable of pivoting relative to the base to enable the said section of strap (10) to move outwards when shoes are put on, characterized in that the said section of the strap is connected to the base via a mechanism (20) which is hinged relative to the base around an axis (7) which is more or less parallel to the longitudinal middle plane of the binding, such that it enables this section of strap (10) to move outwards, said mechanism (20) also comprising a pivot hinge (8) with the said section of the strap to enable this section of the strap to pivot in a folding movement towards base (2).

9 Claims, 4 Drawing Sheets

SNOWBOARDING BINDING

TECHNICAL FIELD

The invention relates to the field of skiing sports, particularly snowboarding. More particularly, it relates to surf bindings, more specifically mechanisms for pivoting the gripping straps relative to the binding base. In the description below, the base is considered as the rigid section of the binding which comes directly or indirectly into contact with the upper surface of the board, which comprises lateral sections along the sides of the shoe and which may include a rear arched part onto which a heel cup is generally mounted.

BACKGROUND ART

In general, snowboard bindings intended to receive flexible shoes comprise a base which is firmly connected to the snowboard on which the shoe is held by one or generally two gripping straps. The gripping straps are located at the foot and instep of the foot. The straps grip the foot firmly to enable the board to be steered. The straps must be capable of pivoting laterally to enable the strap to be moved outwards in order for the shoe to be set in position.

The straps known to date are often made of a flexible, slightly distortable material, as described in European patent EP 1 491 240.

The pivoting movement is therefore achieved due to the distortion of a section of the strap. It has been noted, however, that the rigidity required by the strap section prevents the strap from pivoting freely and that the strap therefore tends to return naturally to the closed position above the base. This may hinder users when they are putting on their shoes because the strap has to be opened manually above the base.

In French patent FR 2 838 979 the Applicant proposes a solution to this problem in which the straps have a certain degree of rigidity and comprise a hinge consisting of a rigid pin around which the strap may pivot. Return means hold the strap in a stable position thereby enabling the shoe to be inserted without users having to hold the strap open manually when they are putting on their shoes.

The two binding straps also constitute protruding parts that it is perhaps advantageous to fold down on the top of the base in order to save space when the board is transported. In order to achieve this, the straps generally include an additional hinge point that enables them to pivot around a transversal axis in order to fold the straps towards the base.

For example, in patents FR 2 838 979 and U.S. Pat. No. 6,679,515 the end of the strap which is mounted on the base comprises a double hinge. The first end hinge enables the strap to pivot around a transversal axis in order for it to fold down on the base. The second hinge is spatially offset to enable the strap to open outwards. The presence of this dual mechanism constitutes a weak point, particularly since the straps are generally under considerable strain from being tightly gripped.

Patent WO 96/24412 describes a binding that includes a complex base the two lateral sides of which are hinged relative to the central section of the base. The sides are themselves connected to sections that act as pedals that automatically fold the straps onto the foot when the user puts on the binding.

The aim of the invention is to propose an alternative solution to this system to enable the double hinge movement to be performed using a simple, compact mechanism.

DISCLOSURE OF THE INVENTION

The invention therefore relates to a snowboard binding. The binding comprises, according to known techniques, a base onto which a foot-gripping strap is mounted, more precisely on the front or instep of the foot.

The strap is capable of moving around a transversal axis to enable the strap to be folded towards the base. In addition, at least one section of the strap is capable of pivoting relative to the base to enable the strap to move outwards when the shoes are put on.

According to the invention, this section of the strap is connected to the base via a mechanism which is hinged relative to the base around an axis which is more or less perpendicular to the longitudinal middle plane of the binding, such that it enables this section of the strap to move outwards. The mechanism also comprises a pivot hinge with the section of the strap in question to enable this section of the strap to pivot in a folding movement towards the base. Advantageously, to improve the compactness of the assembly, the pivot axis of the mechanism relative to the base may be more or less concurrent with the pivot axis of the mobile section of the strap relative to the characteristic mechanism.

In other words, the binding according to the invention includes a strap that is directly hinged relative to the base to enable the strap to open by pivoting outwards. The hinge is extended by a second pivot hinge that enables the strap to fold onto the base. In other words, the invention consists in bringing together both pivoting hinges in the same mechanism. Therefore, unlike the existing devices, particularly those described in patents U.S. Pat. No. 6,679,515 and FR 2 838 979, the entire strap according to the invention is hinged by pivoting outwards. A double hinge is therefore obtained which is more compact and therefore less fragile and requires less space. The pivot axis of the strap enabling it to fold onto the base, which is therefore more or less transversal to the binding, is located next to and may even pass through the pivot pin of the strap enabling the strap to open.

Advantageously, the mechanism may comprise return means on the base hinge in order to force the strap to remain in the open position. In other words, the characteristic mechanism may comprise a spring that acts on the hinge mounted directly on the base in order to hold the strap in an open or stable position.

According to another characteristic of the invention, the mechanism may comprise means to limit the amplitude of its pivoting movement relative to the base. In other words, the characteristic mechanism prevents the strap from excessive opening outwards to avoid the strap adopting a totally folded position on the board while it is open. Quite the contrary, it continues to be easy to handle.

In practice, this limit on amplitude may be obtained by a protruding section connected to the end of the strap which comes into contact to abut against the base when the strap reaches its maximum opening position.

In addition, the mechanism according to the invention may comprise means to force its pivoting movement relative to the base and cause the strap to fold in the direction of the foot under the effect of the shoe moving down towards the base.

In other words, the binding comprises a mechanism that automatically closes the strap onto the foot when the shoe is inserted in the binding, similar to that described in patent WO 96/24412.

In practice, the means for forcing the pivoting movement of the mechanism may comprise a lever connected to the end of the strap at the hinge which extends towards the interior of the base.

According to another characteristic of the invention, the strap may comprise a telescopic device connected to the hinge mechanism to adjust the length of the strap to the shoe size.

In addition, the characteristic mechanism may also comprise means for limiting the pivoting movement of the strap towards the rear. In other words, the characteristic mechanism may be such that it enables the strap to fold completely towards the front, but prevents the strap from being folded towards the rear to facilitate positioning the strap when the shoe is put on.

According to one particular embodiment, the mechanism may comprise:

a hinge pin connected to the base, and an intermediary clevis comprising two feet mounted on the hinge pin and a central section constituting the pivot pin on which the strap is mounted.

a cowl mounted so that it is capable of pivoting around the intermediary clevis, the cowl being connected to the rest of the strap.

BRIEF DESCRIPTION OF THE FIGURES

The method for producing the invention and resulting advantages will be better understood from the following description of the embodiment referring to the attached figures where.

SUMMARY OF THE INVENTION

Figure 1:
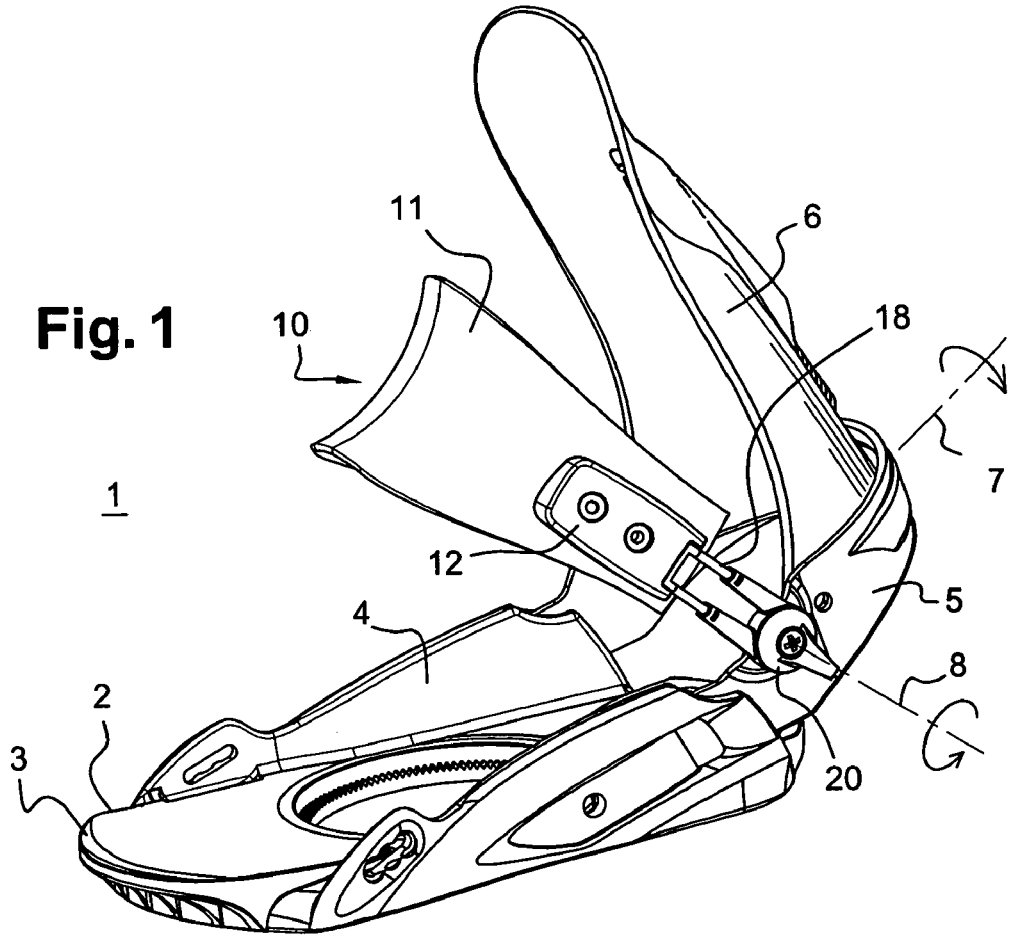
FIG. 1 is a simplified perspective view of a binding according to the invention, seen from the exterior.

As shown in FIG. 1, binding (1) mainly comprises a base (2), including a lower section (3), lateral sides (4) and an arched part (5). Lower section (3) is intended to come into contact with the board and extends laterally with sections (4) along the lateral sides of the shoe. Towards the rear the two sections (4) receive the arched part (5) that supports the heel and bears a hinged heel cup (6).

According to the invention, binding (1) comprises a strap (10) intended to grip the shoe by binding it onto the instep. The invention is clearly not limited to the strap only operating in conjunction with the instep, but also covers the forward straps that are not shown.

Strap (10) comprises a central section forming a cushion filled with padding (11). Cushion (11) is connected to a telescopic device (12) connecting it to the rigid section of the strap. The rigid section includes two arms (13) connected to the characteristic mechanism (20) enabling strap (10) to pivot relative to arched part (5).

Figure 2:
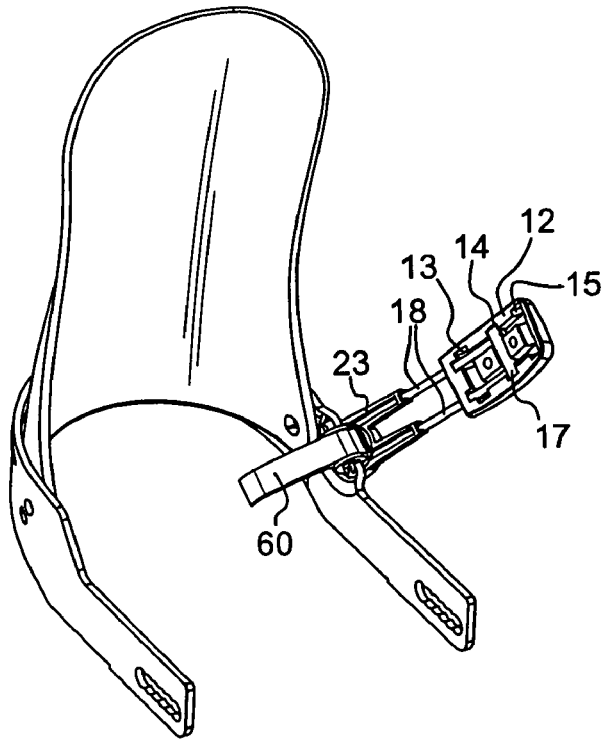
FIG. 2 is a simplified perspective view, seen from the interior, of the binding in FIG. 1 in which only the arched part is shown, the lower section of the base not having been included.

As illustrated in FIG. 2, telescopic device (12) therefore comprises three grooves (13, 14 ,15) on its inner surface capable of receiving a transversal rod (17) in three positions. Part (12) is connected to the central section or cushion (11) of the strap (10) by a sliding system (not shown) which, when it is disconnected, enables transversal rod (17) to slide into the appropriate groove (13-15).

Transversal rod (17) is connected to characteristic mechanism (20) via two parallel longitudinal rods (18) that form a loop mounted in a cowl (23) on the end of strap (11) and connected to characteristic mechanism (20).

Figure 3:
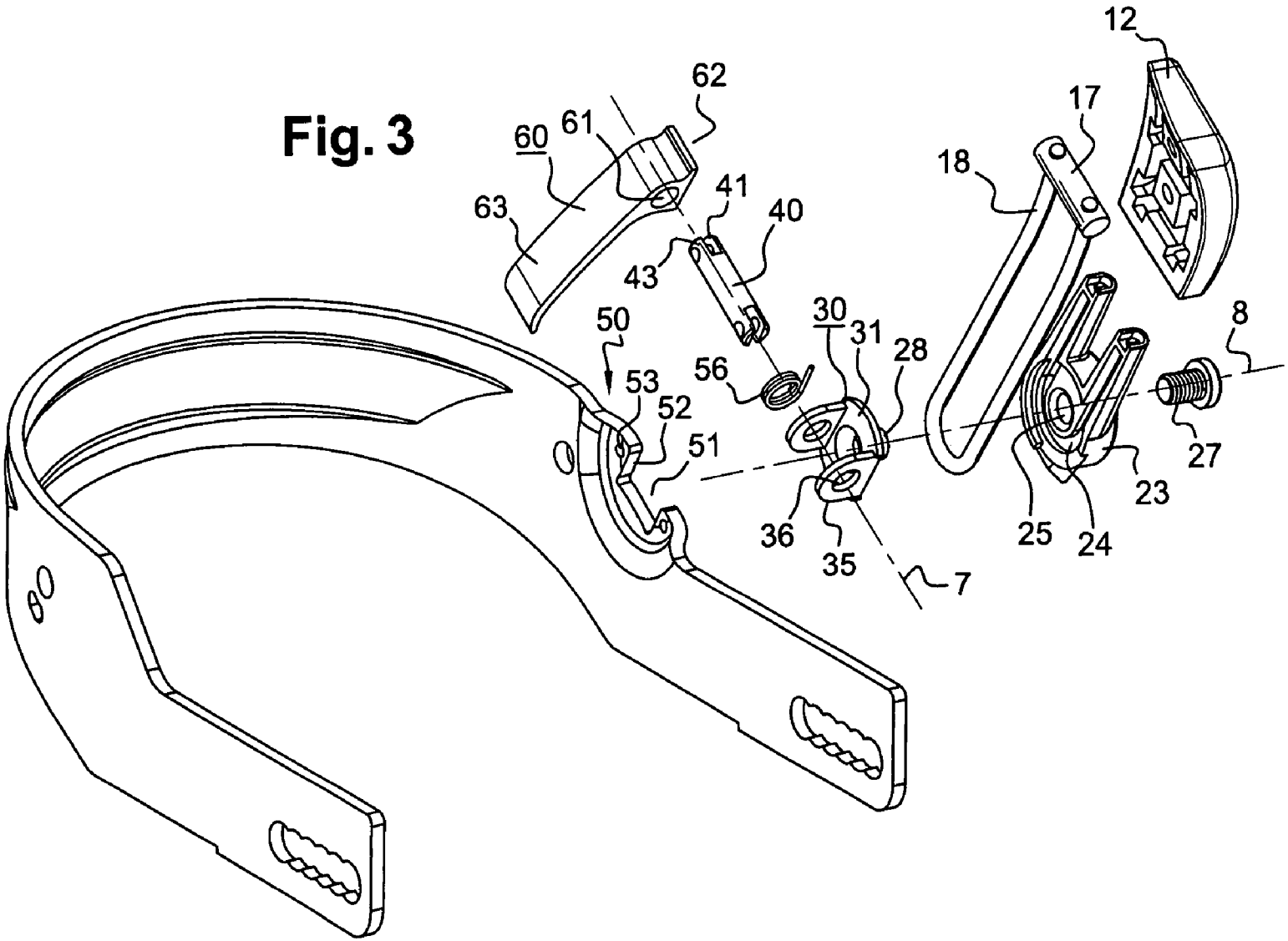
FIG. 3 is a simplified, exploded perspective view of the mechanism of the invention.

The construction of this mechanism is shown more clearly in FIG. 3 with part (12) receiving transversal rod (17) mounted on the end of longitudinal rods (18) that are connected in a "U" and inserted in a groove (24) of cowl (23). The centre of cowl (23) comprises an opening (25) the outside of which receives screw (27) and the inside of which threaded cylinder (28) of clevis (30). Screw (27) maintains cowl (23) connected to clevis (30) while cowl (23) may rotate around cylinder (28) of clevis (30). The inner surface of section (31) of clevis (30) receives two parallel feet (35) each pierced with an opening (36).

Openings (36) are intended to receive a pin (40) to enable clevis (30) to rotate relative to said pin (40) . Pin (40) presents recesses (41) at each end to enable it to be installed in assembly zone (50) of arch part (5) on the base. More precisely, zone (50) comprises a recess (51) enabling feet (36) of the clevis to be positioned. Housing (51) is defined by sections of surface (52) of the base that fit into recesses (41) of pin (40) . A pin or screwing system may be provided to pass through holes (53, 43) present in the base and pin (40) Pin (40) may also be moulded at the same time as the base and receive the intermediary clevis by being clipped into place.

Mechanism (20) presents two concurrent axes of rotation, i.e. a first axis of rotation (7) enabling the strap to pivot from the inside outwards (and vice versa) and a second axis (8) enabling the strap to rotate from the fore to the rear (and vice versa).

A return spring (56) may be provided on pin (40) to be inserted between feet (36) of clevis (30). Spring (56) operates in conjunction with section (31) of clevis (30) on the one hand, and the outer surface of the base in assembly zone (50), on the other, in order to force clevis (30) to pivot around pin (40) in the outwards direction of the strap opening, according to arrow E.

In addition, the mechanism comprises a lever (60) presenting a hole (61) intended to receive pin (40) when positioned between feet (36) of clevis (30). A surface (62) of the lever is intended to come into contact with section (31) of clevis (30) to pivot with the latter. Lever (60) presents a section (63) arranged to come into contact with the user's shoe, particularly the lateral surface of the shoe, when inserted in the binding.

Lever (60) is preferably made of a flexible material. The lever must be sufficiently long to be effective with narrow shoes but must not hinder users putting on wider shoes. In this situation the lever retracts by becoming elastically distorted along the sides of the base.

Figure 4:
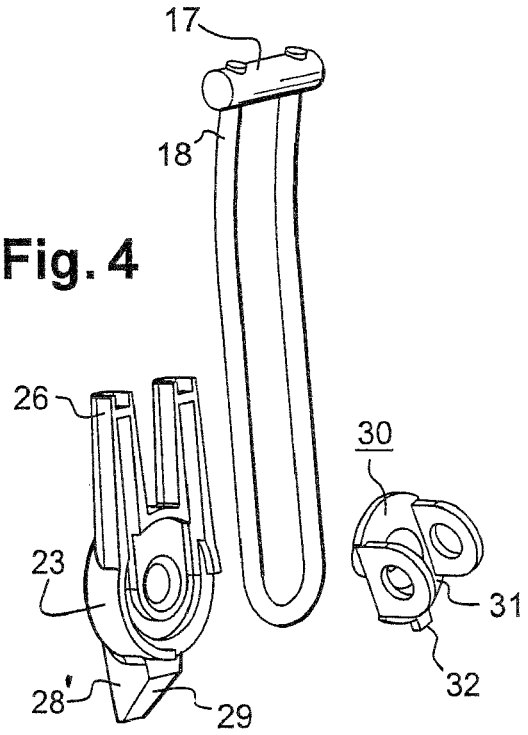
FIG. 4 is a simplified perspective view showing certain assembly parts of the end of the strap, shown assembled in FIG. 5.
Figure 5:
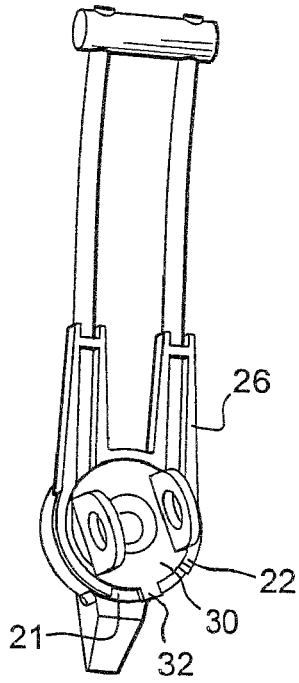

FIG. 4 shows another characteristic of the invention resulting from a specific section of cowl (23). Cowl (23) includes a protruding section (28') arranged opposite the rest of the strap, a surface (29) of which is configured to come into contact with the outer surface of the base when the strap is open. The strap is therefore prevented from pivoting excessively outwards and coming to rest on the upper surface of the board.

FIG. 4 also illustrates grooves (24) moulded in cowl (23). The grooves are intended to receive longitudinal rods (18) at whose end is fastened transversal rod (17) of the telescopic mechanism for adjusting the length of the strap. Arms (26) of cowl (23) increase the stiffness in flexion of rods (18) to improve the efficiency of the hinge system opening.

After cowl (23) has been assembled on characteristic clevis (30), cowl (23) pivots around the axis of cylinder (8) (not shown in FIG. 4) present on the outer surface of section (31) of the clevis. A lug (32) is arranged on the circumference of circular section of portion (31) to abut against shoulders (21,22) on cowl (23). The rotation movement of the cowl relative to the clevis is therefore limited in its amplitude to prevent the strap from pivoting excessively towards the rear when it comes into contact with shoulder (22).

On the other hand, shoulder (21) is positioned such that it enables the strap to pivot forwards until it comes into contact with the binding or board.

Figure 6:
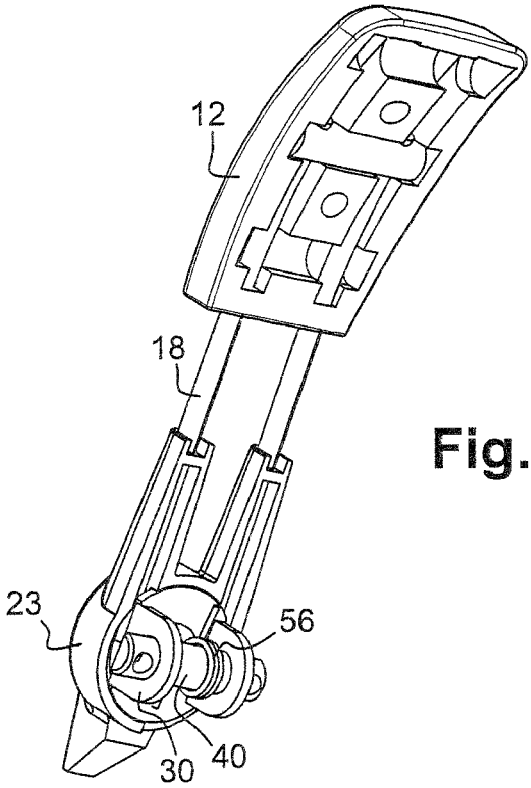
FIG. 6 is a simplified perspective view of the end of the strap, shown from the inside, including various additional parts of the characteristic mechanism.

FIG. 6 shows the end of the assembled strap including clevis (30) on pin (40), return spring (56), except for lever (60), but including longitudinal rods (18) and part (12) on which padded section (11) of the strap is fastened. It may therefore be noted that the clevis may pivot around pin (40) which is immobile relative to the base. The hinge therefore allows the opening movement of the strap to enable the foot to be inserted, then the strap to be closed when folded onto the shoe.

Figure 7:
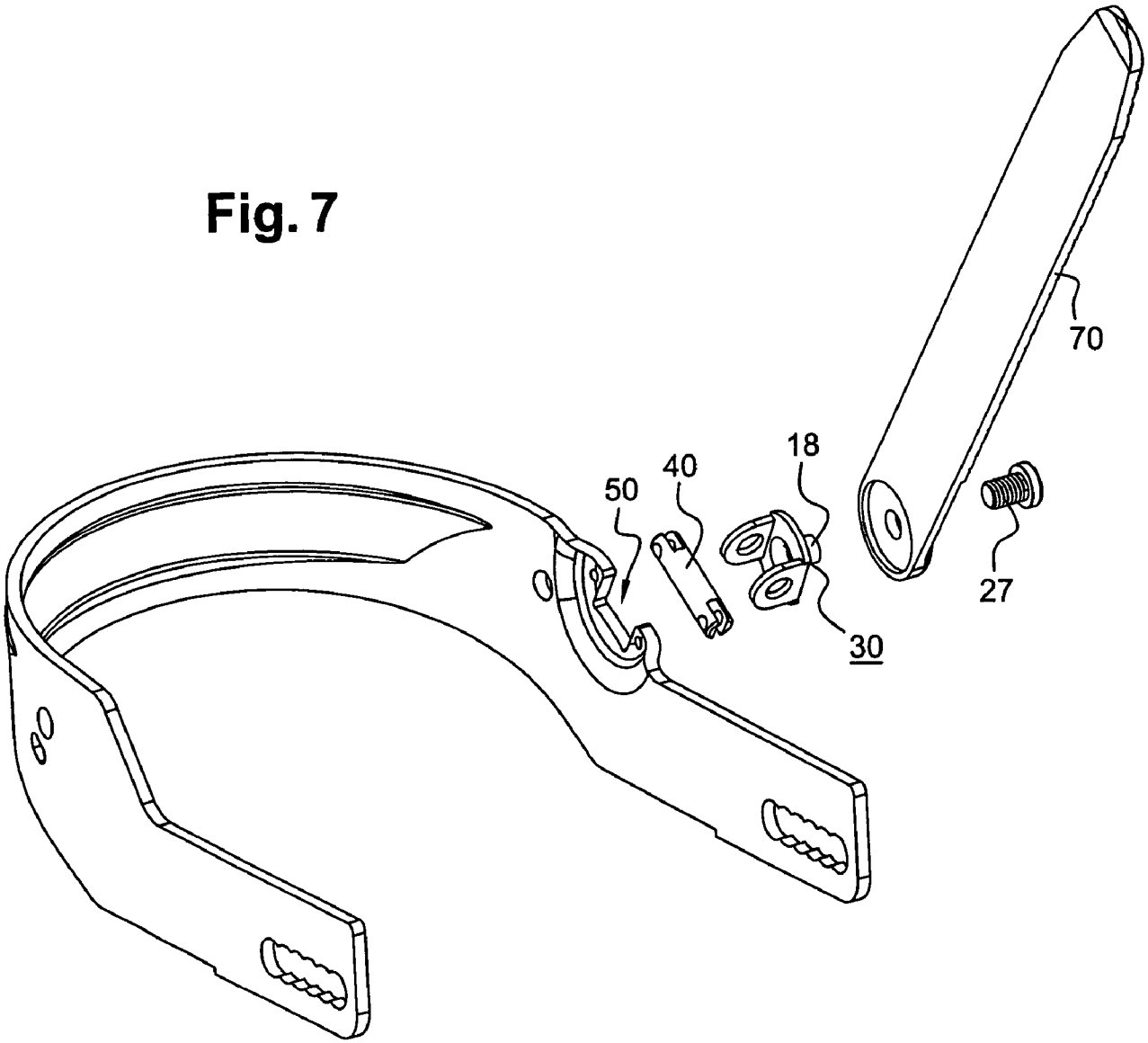
FIG. 7 is a simplified perspective view of an arched part equipped with a second type of strap.

In addition, cowl (23) pivots relative to its assembly axis (8) on clevis (30), axis (8) being as shown in the figure, concurrent with rotating axis (7) of pin (40) which is connected to the base. Both pivoting movements are therefore performed using a single, compact mechanism. Such a mechanism can clearly be used for either the fore or rear straps. It may be used on one and/or the other side of the strap. For example it may be used as illustrated in FIG. 7 to assemble the part of the strap comprising ratchet (70) intended to operate in conjunction, for gripping purposes, with the clipping mechanism present on the other section of the strap. Under these circumstances, the characteristic mechanism consists solely in pin (40) and clevis (30), due to the fact that the hinged end of the ratchet acts as the cowl (23) described above.

Such a device therefore presents the advantage of bringing together in a very limited zone the two pivoting movements enabling the strap, on the one hand, to open and to fold onto the base during transport, on the other.

The invention claimed is:

1. A snowboard binding (1), comprising:

a base (2) including an arch part (5);

a foot gripping strap (10);

a hinge mechanism (20) engaged to said strap;

a first element (30) of said mechanism (20) fixed on said base (2) which pivots around a first axis (7) substantially transverse to the longitudinal length of said base;

a second element (23) of said mechanism (20) pivotably engaged on said first element (30) to pivot relative to said first element around a second axis (8) substantially along the longitudinal length of said base;

wherein said first axis (7) and said second axis (8) intersect in the same plane.

2. Snowboard binding as claimed in claim 1, wherein the hinge mechanism (20) has return means (56) in order to force the strap to remain in an open position away from the base.

3. The snowboard binding as claimed in claim 1, wherein the first element and the second element have means (21,32, 22) therebetween which limit the amplitude of the pivoting of the second element relative to the first element and to the base.

4. The snowboard binding as claimed in claim 1, wherein the second element has a protruding section (28) which forms an integral part of an end of the strap which comes into contact with the arched part (5) engaged on the base (2) when the strap (10) reaches a maximum opening position.

5. The snowboard binding as claimed in claim 1, wherein the hinge mechanism (20) comprises means (60) to force its pivoting movement relative to the base and cause strap the (10) to fold in the direction of the foot under the effect of the shoe moving down towards the base.

6. The snowboard binding as claimed in claim 5, wherein the means to force the pivoting movement of the hinge mechanism is a lever (60) connected to a hinged end of the strap which extends towards the interior of the base.

7. The snowboard binding as claimed in claim 1, wherein the strap (10) includes a telescopic device (12) connected to the hinge mechanism (20) to adjust the length of the strap.

8. The snowboard. binding as claimed in claim 1, wherein the first element 8:

has a hinge pin (40) connected to the base, and is an intermediary clevis (30) having two feet (36) mounted on hinge pin (40) and a central section (31), wherein a section (18) constituting a pivot pin on which the strap is mounted is engaged between the first element and the second element.

9. The snowboard binding as claimed in claim 8, wherein the second element is a cowl (23) mounted which pivots on the intermediary clevis (30), said cowl being connected to the strap.

* * * * *